United States Patent [19]

Rathi et al.

[11] Patent Number: 4,653,655

[45] Date of Patent: Mar. 31, 1987

[54] CRANE BOOM HAVING VARIABLE ANGLE OFFSET CAPABILITY

[75] Inventors: Ram N. Rathi; Lembit Vaerk, both of Cedar Rapids, Iowa

[73] Assignee: Harnischfeger Corporation, Brookfield, Wis.

[21] Appl. No.: 812,336

[22] Filed: Dec. 23, 1985

[51] Int. Cl.[4] ..... B66C 23/42

[52] U.S. Cl. ..... 212/188; 212/177; 212/187; 212/266

[58] Field of Search ..... 212/175, 177, 182, 187, 212/188, 266

[56] References Cited

U.S. PATENT DOCUMENTS

| | | | |
|---|---|---|---|
| 3,698,569 | 10/1972 | Lamer et al. | 212/177 |
| 3,945,333 | 3/1976 | Fritsch et al. | 212/177 |
| 4,091,936 | 5/1978 | Wuerflein et al. | 212/182 |
| 4,106,631 | 8/1978 | Lundy | 212/177 |
| 4,484,686 | 11/1984 | Mentzer | 212/266 |
| 4,491,229 | 1/1985 | Behrendt et al. | 212/177 |
| 4,512,482 | 4/1985 | Mentzer | 212/266 |

*Primary Examiner*—Joseph F. Peters, Jr.
*Assistant Examiner*—Thomas J. Brahan
*Attorney, Agent, or Firm*—James E. Nilles; Nicholas A. Kees

[57] ABSTRACT

A mobile crane having a boom and a boom extension connected thereto with a toggle linkage for connecting the boom extension to the boom to allow the boom extension to be offset from the boom by one of a plurality of predetermined angles. A pair of double links is pivotably attached to the boom extension while a pair of single links is pivotably attached to the upper sheave pin in the boom head. Both the single and double links have a hole in the opposite end. Either the single or double links also have a hole in at least one intermediate position. The link having one hole is then pinned to the other link having two holes, the hole selected in the second link determining the angles of offset when tension is applied to the linkage by pivoting the boom extension about the lower sheave pin after removal of the upper boom foot pins. Biasing devices are provided to cause the linkage, which pivots freely at both ends and in the middle, to toggle upward when tension thereon is released. A storage position is provided for storing the double links and the link connector pins so as to prevent interference with the other apparatus and loss of the connector pins when the linkage is not in use.

18 Claims, 9 Drawing Figures

CRANE BOOM HAVING VARIABLE ANGLE OFFSET CAPABILITY

BACKGROUND OF THE INVENTION

This invention relates to cranes having booms and extensions connected thereto and in particular to such extensions which have the capability of being fixed at a plurality of distinct angles of offset in a vertical plane and relative to the center line of the crane boom.

A previous offset boom arrangement is shown in the Mentzer U.S. Pat. No. 4,484,686, which discloses a slotted tension link arrangement wherein a pin is allowed to slide freely in the slot when the boom extension is in a certain position, and require high manufacturing and holding tolerances.

Another example is the Miller U.S. Pat. No. 3,085,695, which shows a crane boom with a hinge arrangement and a multi-position linkage that allows the different parts of the boom to assume a plurality of relative angles. This arrangement is not easily adaptable to an existing crane boom since the upper crane connection described therein would not work without the link arrangement of that invention.

The present invention relates to improvements over the apparatus described above and to solutions to the problems raised thereby.

SUMMARY OF THE INVENTION

The invention relates to cranes having a boom extension and an upper boom head, and includes two double links pivotably connected to either one of the extension or the head and two single links pivotably connected to the other. Each of the double links has two holes arranged one at the distal end of the link and one intermediate the length of the link. When the minimum offset, usually two or three degrees, is desired, the linkages need not be connected and may be merely folded out of the way. When the maximum offset, usually about 30 degrees, is desired, the single links are connected to the holes at the distal end of the double links. When an intermediate offset, usually 15 to 17 degrees, is desired, the single links are connected to the intermediate holes of the double links.

To connect the links, the boom extension is lowered to the ground or supported by some other firm support. The upper boom connector pins are removed, and the links are pinned together. Normally in this supported position the links will not be horizontally aligned but rather will protrude upward to the point of pinning. Then when the boom is lifted off the support, the linkage becomes taut as the upper boom head connection is allowed to separate. Thus the boom extension offset position is automatically determined by the selection of the proper holes in the linkage. Biasing means biasing the linkage upward are also provided so as to prevent the linkage from falling and interfering with the adjacent structure when tension on the linkage is released. These biasing means have the further advantage that the pin and linkage surfaces are held in contact in the event of a low magnitude boom bounce, reducing the chance of damage to the linkage by repeated impact loading. This is a substantial advantage over the slotted linkage shown in the Mentzer patent.

The invention provides a crane of the type having a boom and a boom extension pivoted thereto, the extension being connected to the boom by the above apparatus for selecting any one of a plurality of fixable angles of offset between the boom and boom extension, which apparatus is easily and quickly connected and disconnected, and which apparatus reduces or prevents damaging impact loading.

The invention also provides a means of connection between a boom and boom extension for allowing the extension to pivot with respect to the boom to one of a plurality of fixed, non-slidable angles of offset, such that damaging impact loading is prevented.

A more specific aspect of the invention provides a boom extension with a linkage biased upward so as to prevent the linkage from falling and interfering with the adjacent structure when tension is released and so as to reduce or prevent impact loading of the linkage components which could result in damage.

Other objects and advantages of the invention will appear in the disclosure which follows.

DESCRIPTION OF THE PREFERRED EMBODIMENTS

Figure 1:
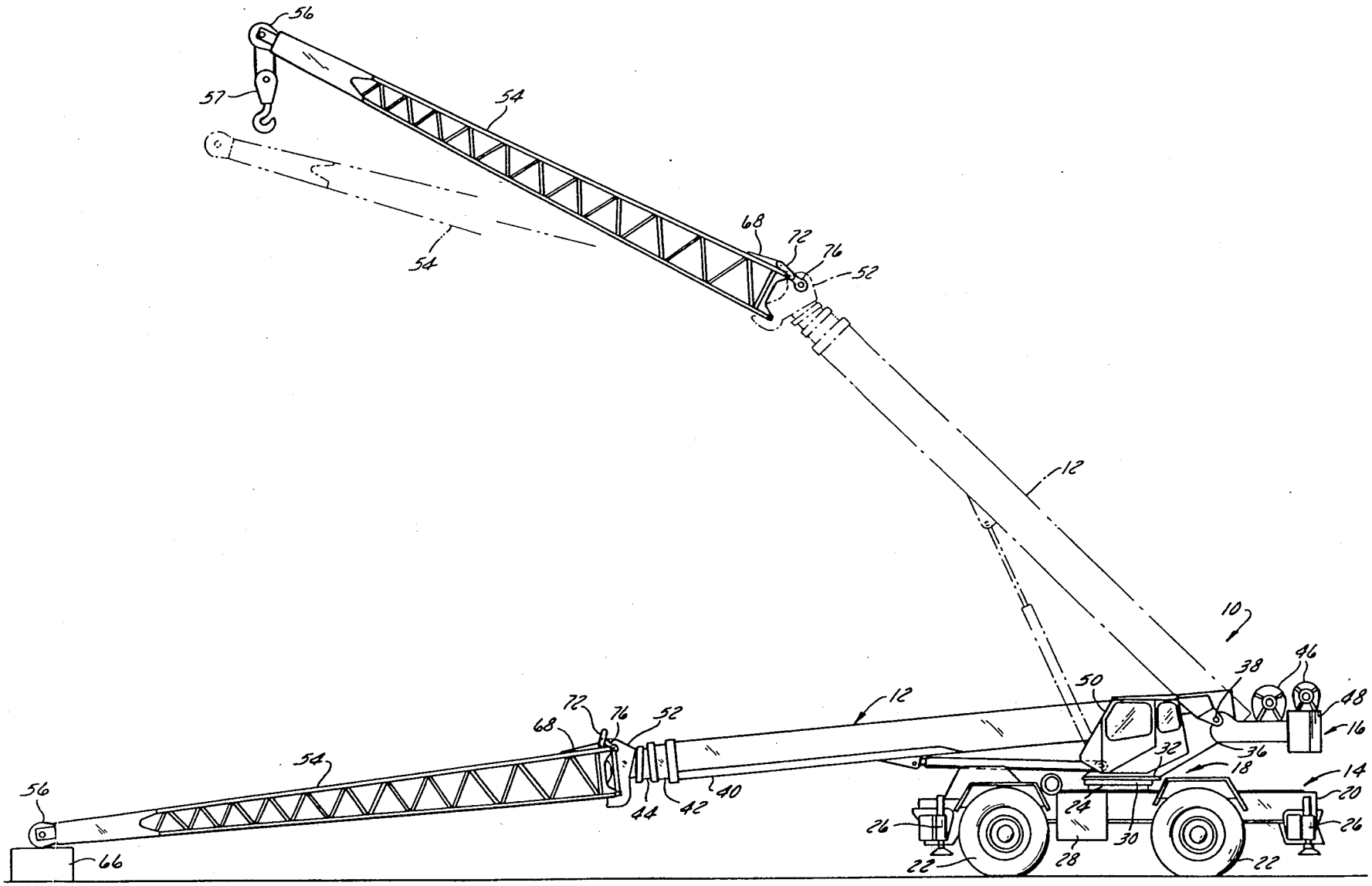
FIG. 1 is a side elevational view of a mobile crane having a boom and boom extension with a variable angle offset capability in accordance with the invention.

Referring now to FIG. 1, there is shown a self-propelled vehicle generally at 10, such as a mobile crane, carrying a telescopic crane boom 12. Crane 10 also includes a lower section 14 on which an upper section 16 is mounted by means of a slew ring assembly 18 for rotation in either direction to an unlimited degree about a vertical axis during crane operation. Lower section 14 comprises a chassis 20 on which are mounted four wheel assemblies such as 22, a fixed ring 24 of the aforesaid slew ring assembly 18, four extendible outriggers such as 26 for deployment during crane operation, a source of power (not shown) such as an internal combustion engine for providing operating power to the crane and for providing motive power for the wheel assemblies 22, and a hydraulic fluid reservoir 28 for supplying operating fluid to certain vehicle and crane components. Upper section 16 comprises a rotatable ring 30 of the aforesaid slew ring assembly 18 and a support frame 32 which is rigidly secured to ring 30. A boom support assembly 34 is rigidly mounted on support frame 32 and telescopic boom 12 is mounted by means of a pivot assembly 36, including a pivot pin 38, on support frame 32 for pivotal movement between raised and lowered positions about a horizontal axis during crane operation. Telescopic boom 12 includes a base boom section 40, an inner boom section 42 telescopable within the base boom section, an outer boom section 44 telescopable within the inner boom section, and at least one hydraulic ram (not shown) for effecting extension and retraction of boom sections 42 and 44. Support frame 32 also affords support for two cable winches such as 46, a counterweight 48 and an operator's cab 50. Boom 12 terminates in a boom head 52, to which is attached a jib or boom extension 54 in a manner as described below. Boom extension 54 then terminates in a sheave assembly 56, from which is suspended a hook block assembly 57 when the boom is in the raised position as shown in phantom in FIG. 1.

Figure 3:
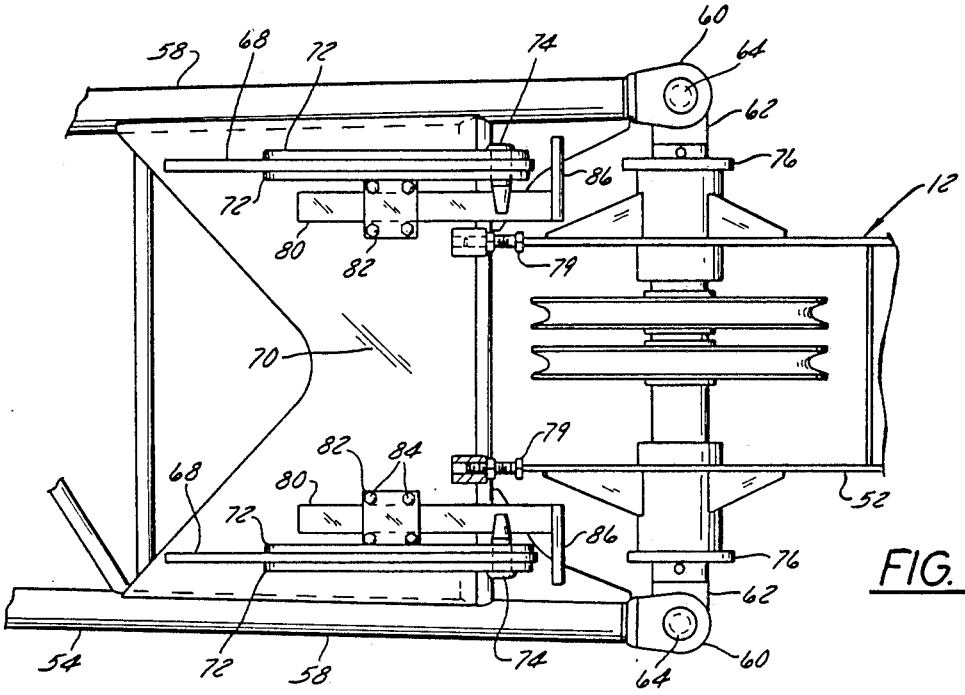
FIG. 3 is a top view of the apparatus shown in FIG. 2.
Figure 2:
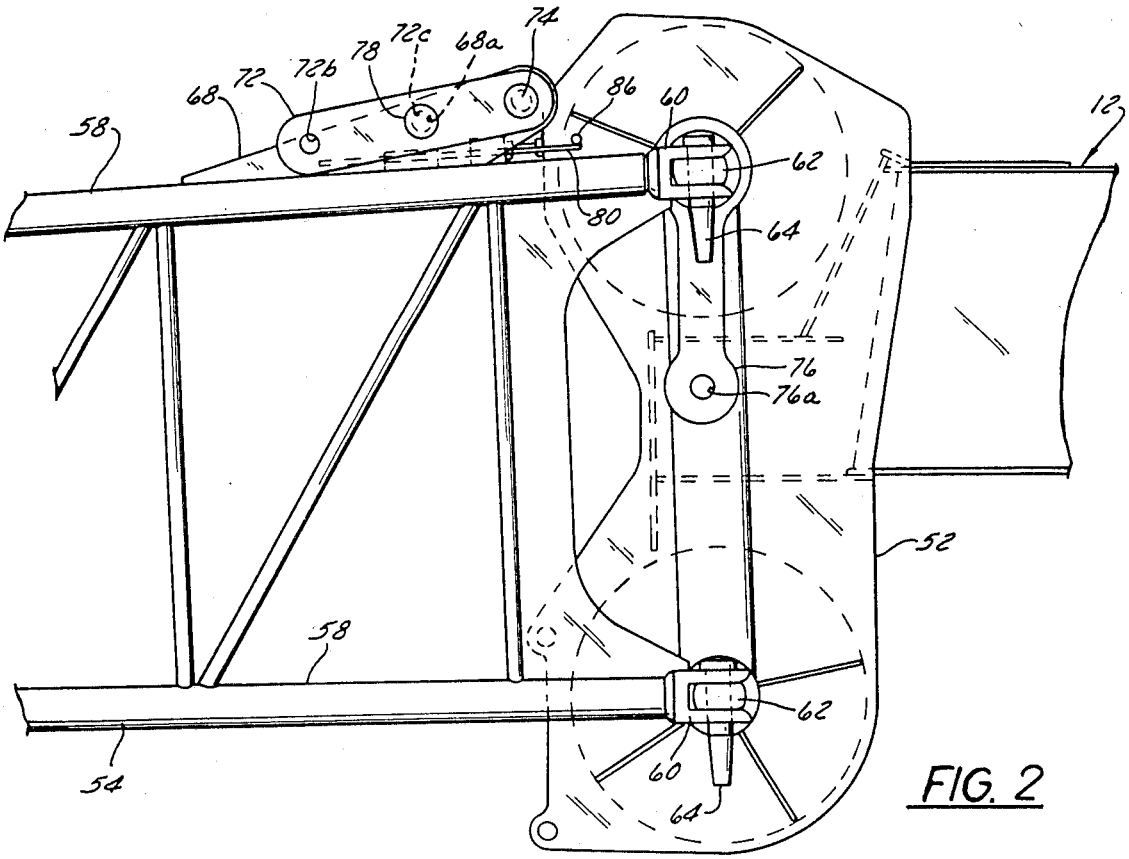
FIG. 2 is an enlarged side elevation view of the connection between the boom and boom extension in accordance with the invention, and showing the links inoperative.

Referring now to FIGS. 2 and 3, the boom extension 54 is shown attached in the position of minimum offset, usually about two to three degrees. Each of the members 58 of the lattice of boom extension 54 terminate in a clevis 60 which fits over the flattened end of each of two vertically spaced apart boom head sheave pins 62 on each side of the boom head 52. A foot pin 64 is then inserted through each clevis 60 and sheave pin 62 to connect the assembly. When thus assembled, the relative placement of the sheave pins 62 within the boom head 52 determines the angle of offset.

Figure 4:
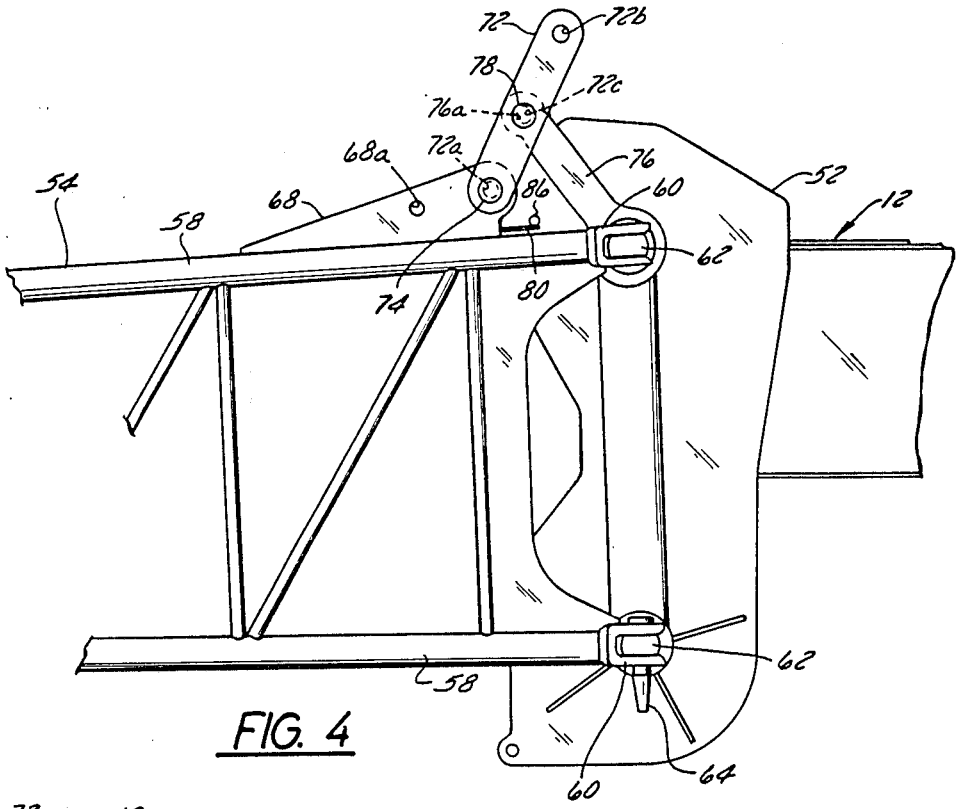
FIG. 4 is a view similar to FIG. 2 except that the links are connected and the upper boom connector pin is removed.
Figure 4A:
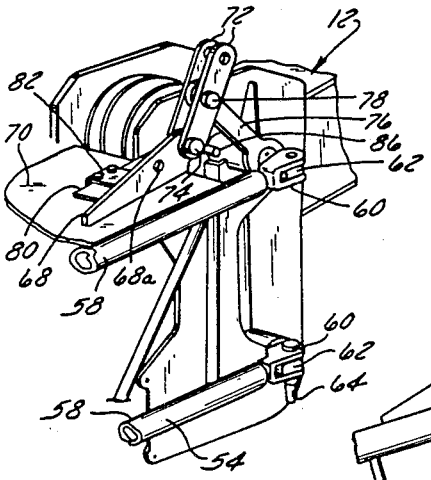
FIG. 4A is a fragmentary, isometric view of the apparatus shown in FIG. 4, but on a reduced scale.
Figure 5:
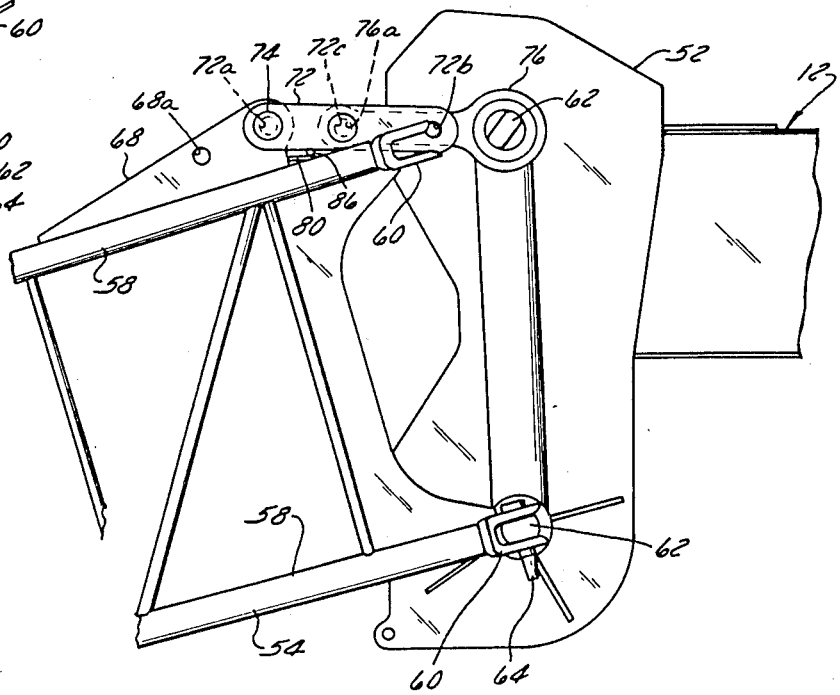
FIG. 5 is a side elevational view of the connection between the boom and boom extension shown in FIG. 4, but with the boom extension offset to an intermediate position.

FIGS. 4, 4A and 5 show the use of a toggle linkage to allow several different predetermined and fixable offset angles. First, the boom is lowered to a position as shown in FIG. 1 wherein the distal end of boom extension 54 and sheave assembly 56 are resting on the ground or some cribbing or other secure support 66, relieving the loading of the upper foot pins 64. The toggle linkages are then assembled as follows. A flange 68 has previously been permanently attached, such as by welding, to the webbing 70 (FIG. 3 as well as FIG. 4A) between the upper lattice members 58 of boom extension 54 for each linkage. To each such flange 68 is attached a double link 72 so as to pivot on a pin 74. Besides the hole 72*a* in which pin 74 is fitted, each double link has a hole 72*b* at the opposite end and a third hole 72*c* between the other two, shown best in FIGS. 4 and 5. A single link 76 is pivotably attached to the upper sheave pin 62 for each double link 72, and has a hole 76*a* (FIG. 2) in the opposite end thereof. To set the linkage, then, for an intermediate offset as shown in FIGS. 4, 4A and 5, hole 76*a* of single link 76 is aligned with the intermediate hole 72*c* of double link 72 and a link pin 78 is removably inserted or extended therethrough. Upper foot pin 64 is then removed so that upper clevis 60 can separate from upper sheave pin 62. The apparatus then appears exactly as shown in FIGS. 4 and 4A. Finally, the boom 12 is raised off support 66 (FIG. 1), boom extension 54 is permitted to pivot about lower sheave pins 62, and the linkage is made taut. The apparatus then appears as shown in FIG. 5.

Figure 6:
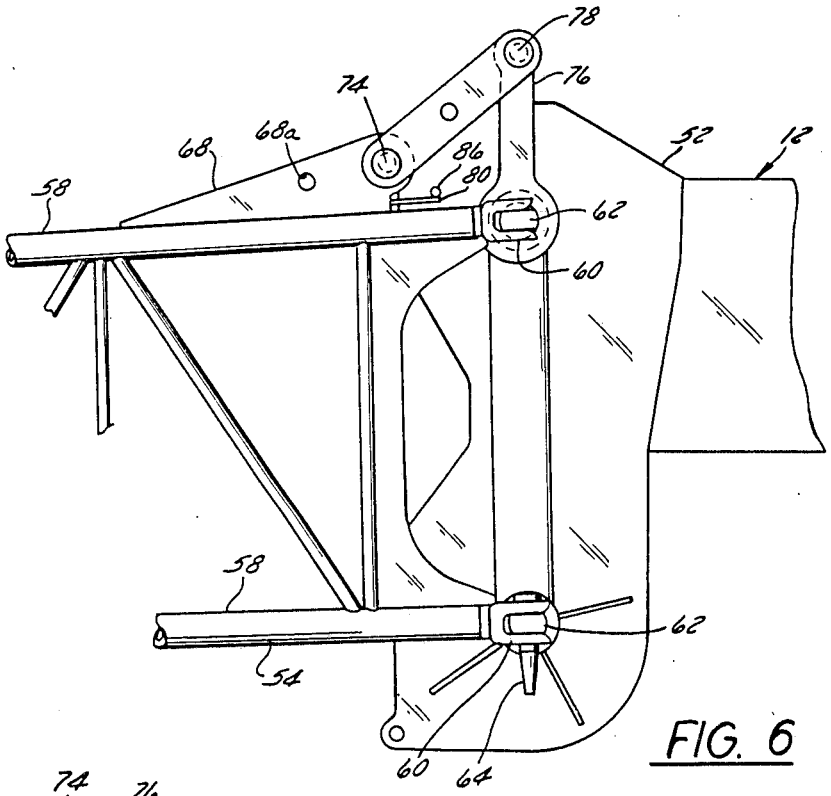
FIG. 6 is a view similar to FIG. 4 except that the linkage is arranged for the maximum offset.
Figure 7:
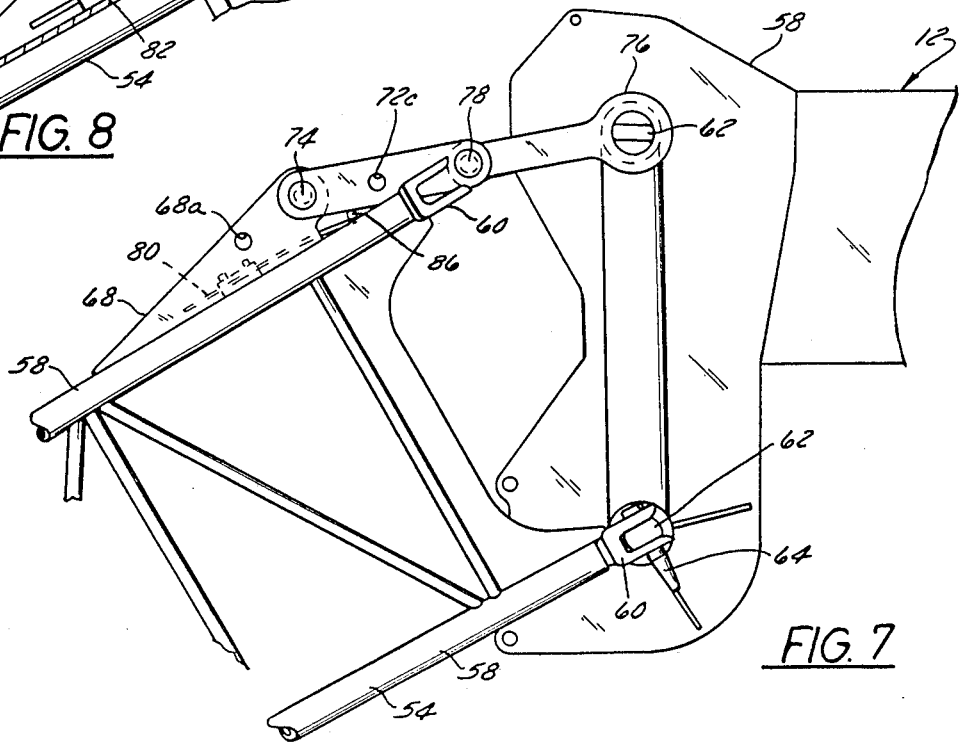
FIG. 7 is a view similar to FIG. 5 except that the boom extension is offset to the maximum position.

FIGS. 6 and 7 show the assembly of the linkage for maximum offset. The structure of the apparatus is identically the same as that shown in FIGS. 4, 4A and 5. In FIGS. 6 and 7, however, the hole 76*a* of single link 76 is aligned with the distal hole 72*b* of double link 72, and the pin 78 inserted. Then when the boom is lifted the apparatus appears as shown in FIG. 7, and the maximum offset is achieved.

Figure 8:
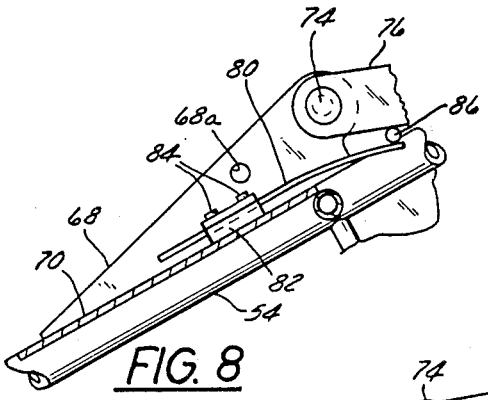
FIG. 8 is a fragmentary, side elevational view of part of the apparatus shown in FIG. 7, enlarged and partially in section to show the biasing arrangement.

Again, in order to change the offset, tension on the linkage must be relieved, such as by supporting the distal end of boom extension 54. When boom extension is thus supported as shown in FIG. 1, upper lattice members 58 move toward boom head 52 until stops 79 located on the lattice contact the boom head, as shown in FIG. 3. These stops 79 are preferably adjustable and should be adjusted so that when they contact boom head 52 the upper boom head sheave pins 62 are aligned with the clevises 60 of boom extension 54, so that foot pins 64 may be inserted if that action is desired. Since both the double links 72 and the single links 76 are free to pivot, however, biasing means must be provided to bias the links upward and prevent the links and pin 78 from falling and interfering with the other apparatus when tension is relieved. In the embodiment shown in the Figures, and particularly FIGS. 3 and 8, there is provided a leaf spring 80 attached at one end by any suitable means to webbing 70 or lattice members 58 of boom extension 54. The attachment means should preferably allow for adjustment of the position of leaf spring 80 so as to determine the amount of spring pressure exerted and the location of the distal end of the spring. As shown in FIG. 8, this attachment means is a block 82 secured to webbing 70, through which leaf spring 80 is slid. The spring is then tightened down such as by means of set screws 84. A contact bar 86 may be affixed to the distal end of leaf spring 80 in order to allow the spring to more reliably contact and exert upward force on the linkage. As shown there as well as in FIGS. 5 and 7, when the linkage is taut, the leaf spring 80 is deflected downward. Thus when tension is released, the leaf spring 80 kicks the linkage upward so that any interference of the linkage with the rest of the apparatus is avoided. Hence the linkage will always point upward when not taut.

Because the boom extension 54 may be folded alongside the boom 12, such as for transport or storage, it may be desirable to provide for a storage position for the linkage, since the storage position for the boom extension 54 requires removal of the foot pins 64 on one side of the extension and pivoting the boom extension horizontally on foot pins 64 on the opposite side of the extension to fold the extension 54 alongside the boom 12 itself. In addition, the linkage connector pins 78, when removed, may be subject to loss or misplacement. Accordingly, a hole 68*a* may be provided in each of flanges 68 at a position to align with intermediate hole 72*c* of double links 72. Then when double links 72 are disconnected from single links 76 by removal of pin 78, double links 72 are pivoted back on pin 74 and pin 78 inserted through holes 72*c* and 68*a*. Single links 76 are allowed to suspend freely from upper sheave pins 62. A further advantage of this arrangement, besides securing links 72 from interfering with the apparatus, is to provide a place for keeping pin 78 between uses in the linkage.

While the apparatus hereinbefore described is effectively adapted to fulfill the aforesaid objects, it is to be understood that the invention is not intended to be limited to the particular preferred embodiments of crane boom apparatus herein set forth. Rather, the invention is to be taken as including various equivalents without departing from the scope of the appended claims. For instance, the attachment of the double links 72 and single links 76 could be exchanged so that the single links 76 are attached to the boom extension 54 and the double links 72 are attached to the boom head 52. Similarly, single links 76 could be given an intermediate hole instead of the hole 72*c* in double links 72. Moreover, the biasing arrangement for keeping the links from interfering with the other apparatus could be attached to the boom head 52 instead of the boom extension 54. These and other changes could obviously be made within the scope of the appended claims. However, it is critical that the holes mentioned are not slots, so as to avoid impact loading of the links and associated pins in the event of boom bounce.

I claim:

1. In a crane of the type having a crane boom and a boom extension angularly pivotable relative thereto, an apparatus for connecting said crane boom to said boom extension to permit a selection of one of several predetermined and fixable offset angles therebetween, said crane boom having a boom head with at least two vertically spaced apart sheave pins therein, said boom extension being pivotally connected to said boom about a lower of said vertically spaced apart pins, said connecting apparatus comprising:

a first link pivotably connected to an upper one of said sheave pins;

a second link pivotably connected to said boom extension;

each of said links having a hole at the end opposite its respective connection;

at least one of said links having a hole intermediate its length; and a pin removably extendable through one of the holes of said at least one of said links and also through the end hole of the other of said links to thereby permit said boom extension to pivot about said lower sheave pin and thereby be angularly offset from said boom head by a predetermined angle depending on which of the holes of said at least one link is selected, so that impact loading of said links and pins in the event of boom bounce is prevented.

2. A crane as recited in claim 1 further comprising means for biasing said links upward so as to prevent interference with the rest of the apparatus when tension on the links is released.

3. A crane as recited in claim 2 wherein said biasing means includes a leaf spring, one end of which is affixed to one of the boom head and the boom extension and the other end of which bears on one of said links, said leaf spring so positioned and biased as to prevent said links from falling and interfering with the rest of the apparatus when tension on the links is released.

4. A crane as recited in claim 1 wherein said at least one link having an intermediate hole is said second link attached to said boom extension.

5. A crane as recited in claim 1 further comprising means for storing said second link and said removably extendable pin so as to prevent interference with the rest of the apparatus when said links are not in use.

6. A crane as recited in claim 1 wherein one of said links is a double link and the other of said links is a single link.

7. A crane as recited in claim 6 wherein said double link is said second link connected to said boom extension and said single link is said first link connected to said upper one of said sheave pins.

8. A crane of the type having a crane boom and a boom extension angularly pivotable relative thereto, said crane having an apparatus for connecting said crane boom to said boom extension to permit a selection of one of several predetermined and fixable offset angles therebetween, said crane boom having a boom head with at least two vertically spaced apart sheave pins therein, said boom extension being pivotably connected to said boom about a lower of said vertically spaced apart pins, said connecting apparatus comprising:

a first link pivotably connected to an upper one of said sheave pins;

a second link pivotably connected to said boom extension;

each of said links having a hole at the end opposite its respective connection;

at least one of said links having a hole intermediate its length;

a pin removably extendable through one of the holes of said at least one of said links and also through the end hole of the other of said links to thereby permit said boom extension to pivot about a lower one of said sheave pins and thereby be angularly offset from said boom head by a predetermined angle depending on which of the holes of said at least one link is selected; and biasing means including a leaf spring, one end of which is affixed to one of the boom head and the boom extension and the other end of which bears on one of said links, said leaf spring so positioned and biased as to prevent said links from falling and interfering with the rest of the apparatus when tension on the links is released, so that impact loading of said links and pins in the event of boom bounce is prevented;

wherein said at least one link having an intermediate hole is said second link attached to said boom extension.

9. A crane as recited in claim 8 further comprising means for storing said second link and said removably extendable pin so as to prevent interference with the rest of the apparatus when said links are not in use.

10. A crane as recited in claim 8 wherein one of said links is a double link and the other of said links is a single link.

11. A crane as recited in claim 10 wherein said double link is said second link connected to said boom extension and said single link is said first link connected to said upper one of said sheave pins.

12. Apparatus for connecting a crane boom to a boom extension in a crane to permit a selection of one of several predetermined and fixable offset angles therebetween, said crane boom having a boom head with at least two vertically spaced apart sheave pins therein, said boom extension being pivotably connected to said boom about a lower of said vertically spaced apart pins, said connecting apparatus comprising:

a first link pivotably connected to an upper one of said sheave pins;

a second link pivotably connected to said boom extension;

each of said links having a hole at the end opposite its respective connection;

at least one of said links having a hole intermediate its length; and a pin removably extendable through one of the holes of said at least one of said links and also through the end hole of the other of said links to thereby permit said boom extension to pivot about a lower one of said sheave pins and thereby be angularly offset from said boom head by a predetermined angle depending on which of the holes of said at least one link is selected, so that impact loading of said links and pins in the event of boom bounce is prevented.

13. An apparatus as recited in claim 12 further comprising means for biasing said links upward so as to prevent interference with the rest of the apparatus when tension on the links is released.

14. An apparatus as recited in claim 13 wherein said biasing means includes a leaf spring, one end of which is affixed to one of the boom head and the boom extension and the other end of which bears on one of said links, said leaf spring so positioned and biased as to prevent said links from falling and interfering with the rest of the apparatus when tension on the links is released.

15. An apparatus as recited in claim 12 wherein said at least one link having an intermediate hole is said second link attached to said boom extension.

16. An apparatus as recited in claim 12 further comprising means for storing said second link and said removably extendable pin so as to prevent interference with the rest of the apparatus when said links are not in use.

17. An apparatus as recited in claim 12 wherein one of said links is a double link and the other of said links is a single link.

18. An apparatus as recited in claim 17 wherein said double link is said second link connected to said boom extension and said single link is said first link connected to said upper one of said sheave pins.

* * * * *